United States Patent [19]

Perry

[11] 4,368,873

[45] Jan. 18, 1983

[54] VEHICULAR MOUNTED PIPE PRESSER

[76] Inventor: Robert G. Perry, 3000 Ashwood Dr., Evansville, Ind. 47711

[21] Appl. No.: 75,702

[22] Filed: Sep. 14, 1979

[51] Int. Cl.[3] ..... E02F 5/10; E03F 3/06; F16L 1/02

[52] U.S. Cl. ..... 254/29 R; 405/184; 173/27; 173/36; 173/46

[58] Field of Search ..... 254/29 R; 405/184; 173/34, 35, 36, 27, 46

[56] References Cited

U.S. PATENT DOCUMENTS

| | | | |
|---|---|---|---|
| 2,979,320 | 4/1961 | Adams | 173/34 |
| 3,203,737 | 8/1965 | Robbins et al. | 173/35 X |
| 3,227,419 | 1/1966 | Lackey | 254/29 R |
| 3,726,506 | 4/1973 | Vanderwaal et al. | 254/29 R |
| 3,807,695 | 4/1974 | Gremillion et al. | 254/29 R |
| 3,834,668 | 9/1974 | Casey | 254/29 R |
| 3,907,253 | 9/1975 | Schosek | 254/29 R |
| 3,951,216 | 4/1976 | Crawshay et al. | 173/36 X |
| 4,000,879 | 1/1977 | Martin et al. | 254/29 R |

FOREIGN PATENT DOCUMENTS

| | | | |
|---|---|---|---|
| 694604 | 10/1979 | U.S.S.R. | 405/184 |

*Primary Examiner*—Robert Mackey

*Attorney, Agent, or Firm*—Jenkins, Coffey, Hyland, Badger & Conard

[57] ABSTRACT

A vehicular mounted pipe presser includes a pipe-pressing assembly for pressing pipe through a medium wherein the assembly is movably supported by a vehicle and positionable between surfaces which are transverse to the direction of forces employed to press the pipe. The assembly includes a frame having projectable and retractable feet for engaging the transverse surfaces to stabilize the assembly. Movably carried by the frame is a housing for receiving the pipe and a clamping mechanism which floats with the housing for clamping a portion of the pipe. Two clamp jaws of the clamping mechanism are captured within the housing and pressing forces are limited to the housing and the clamp jaws. The projection and retraction of the feet, reciprocable movement of the housing, and clamping of the pipe within the housing are each separately controllable from a stage carried on the housing by hydraulic systems. The hydraulic system for projecting one of the feet is interconnected to the hydraulic system for applying the forces needed to press the pipe through the ground so that an increase in the pressing force results in a corresponding increase in an opposed force being applied by the foot against an engaged surface to continuously balance the two opposing forces.

21 Claims, 11 Drawing Figures

VEHICULAR MOUNTED PIPE PRESSER

In general, the present invention relates to equipment utilized to push pipe through the ground. More particularly, the apparatus of the present invention relates to a vehicular mounted pipe-pressing assembly which is supported and positioned by a vehicle with respect to surfaces which are transverse to the direction of forces employed to press the pipe through the ground.

Generally speaking, pipe-pushing equipment of the type known in the art has been primarily employed to push pipe under construction attached to the ground surface, e.g., a road surface, to avoid damaging the construction. In many instances, accuracy is crucial in order to assure that the pipe protrudes on the other side of the construction at a required location or that the pipe does not strike other submerged objects, e.g., other pipe lines.

Presently, the conventional equipment is hand-carried into an excavation and positioned at the bottom of the excavation. Accordingly, the depth of the excavation itself must be equivalent to the desired depth of the pipe and further the bottom of the excavation must be level in order to support the equipment. Once the equipment is positioned in the excavation, stakes are driven into the ground in order to stabilize the equipment. Heretofore, the equipment has also included its own power supply for pushing the pipe in four-inch strokes. As can be appreciated, the conventional process of pushing pipe is very cumbersome and time-consuming, since only four inches of the pipe can be pushed through the ground with each stroke. Furthermore, after each four-inch stroke, it is necessary for the operator to manually readjust the equipment for a second four-inch stroke and for each four-inch stroke subsequent thereto. If it is necessary for the pipe to be pushed at a given elevation with respect to the ground surface, the bottom of the excavation has to be levelled at the desired angle of elevation to support the equipment. Importantly, the forces applied by the equipment to push the pipe have been directed in various planes, e.g., against the stakes driven into the ground to stabilize the equipment. Accordingly, after repeated use, the equipment has a tendency to move in response to the pressing forces.

As will become apparent from the disclosure provided herein, the apparatus of the present invention greatly increases the efficiency of pipe-pushing equipment by employing various features which solve many problems associated with the conventional pipe-pushing equipment. In a broad concept, there is provided in accordance with the present invention a vehicular mounted pipe-pressing assembly for pressing pipe through the ground wherein the assembly is movably supported and positioned by the vehicle between surfaces which are transverse to the direction of forces employed to press the pipe through the ground.

One of the features associated with the vehicular mounted pipe presser is that the pipe-pressing assembly is a complete unit which is mountable to a vehicle for positioning within an excavation at a desired depth and angle of inclination with respect to the ground surface.

The assembly further includes a frame having opposed feet for engaging the transverse surfaces to stabilize the assembly within the excavation. A clamping mechanism is carried by a housing which is movable along the frame and the clamping mechanism includes a pair of clamp jaws for grasping the pipe which are captured by the housing so that pressing forces are limited to the housing and the clamp jaws. A hydraulic system for operating the clamp jaws floats with the housing as it is moved to press the pipe through the ground. Accordingly, no pressing forces are applied to the hydraulic system controlling the operation of the clamping mechanism.

Hydraulic systems for projecting and retracting each surface-engaging foot, for reciprocally moving the housing, and for clamping the pipe within the housing are each separately controllable from a stage carried by the frame of the pipe-pressing assembly. The hydraulic system for projecting and retracting a rear foot and the hydraulic system for applying a force to the housing to press the pipe through the ground are interconnected by check valves so that an increase in the force necessary to press the pipe causes a corresponding increase in an opposing force against one of the transverse surfaces. Therefore, the opposing forces associated with pressing the pipe and engaging the back surface of the excavation are continuously balanced in order to provide stability to the assembly. Furthermore, the assembly continuously self-adjusts for shifting of the back surface of the excavation during operation of the apparatus.

A further feature of the present invention is that the pipe may be retracted or removed from the ground as well as pressed through the ground without moving the apparatus. Furthermore, because of the versatility of the apparatus, the assembly may be easily removed from the excavation by the vehicle and completely rotated within a very short period of time so that pipe may be pushed in the opposite direction. It will further be noted that the pipe-pressing assembly does not require that the bottom surface of the excavation be level or be inclined at a desired angle of elevation, since the assembly is supportable above the bottom of the excavation and is positionable at any desired angle of elevation.

Another feature is the process associated with employing the apparatus of the present invention. The process includes the steps of positioning and supporting a conduit pressing assembly in an excavation, stabilizing the assembly at a desired depth in the excavation, and pressing the conduit through the ground by capturing a portion of the conduit within a housing, applying a force to the housing to move the conduit and in response to applying the force to the housing oppositely applying a corresponding force to a rear wall of the excavation.

Other features and advantages of the present invention will become apparent from the following detailed description of an embodiment thereof, which description should be considered in conjunction with the accompanying drawings in which.

In general, the apparatus of the present invention provides a high degree of maneuverability otherwise not associated with conventional pipe-pushing equipment. As will be described in more detail hereinafter, the operator of the present invention has the ability to carry the pipe-pressing assembly from one location to another and position and support the assembly within an excavation by mounting the assembly to a vehicle. Furthermore, the assembly has the ability of either being side mounted or end mounted to allow various positions of the vehicle with respect to the assembly once it has been positioned in the excavation. It should further be noted that once the pipe has been pushed or pressed one direction through the ground, the assembly may be removed from the excavation and repositioned within the excavation to push or press pipe in the opposite direction by merely driving the vehicle around to the other side of the excavation.

Another significant advantage of the present invention is that in positioning the assembly within the excavation it may be supported at any desirable depth and therefore the apparatus is not dependent upon the grade of the bottom of the excavation. The assembly may be inclined to any angle with respect to the ground surface by slight movement of the vehicle so that the pipe may be pressed through the ground at any desired angle of elevation with respect to the ground surface.

Once the assembly has been positioned within the excavation, a pair of movable feet are projectable to engage opposing wall surfaces of the excavation and stabilize the assembly. As will become apparent, the feet may provide the sole support for the assembly and therefore the vehicle may be removed from the assembly after it has been positioned within the excavation. As will be described in more detail, a force is applied by a rear plate to the back wall surface and is increased as an opposing force needed to press the pipe through the ground increases to thereby balance the opposing forces and assure stability of the assembly during operation.

Figure 1:
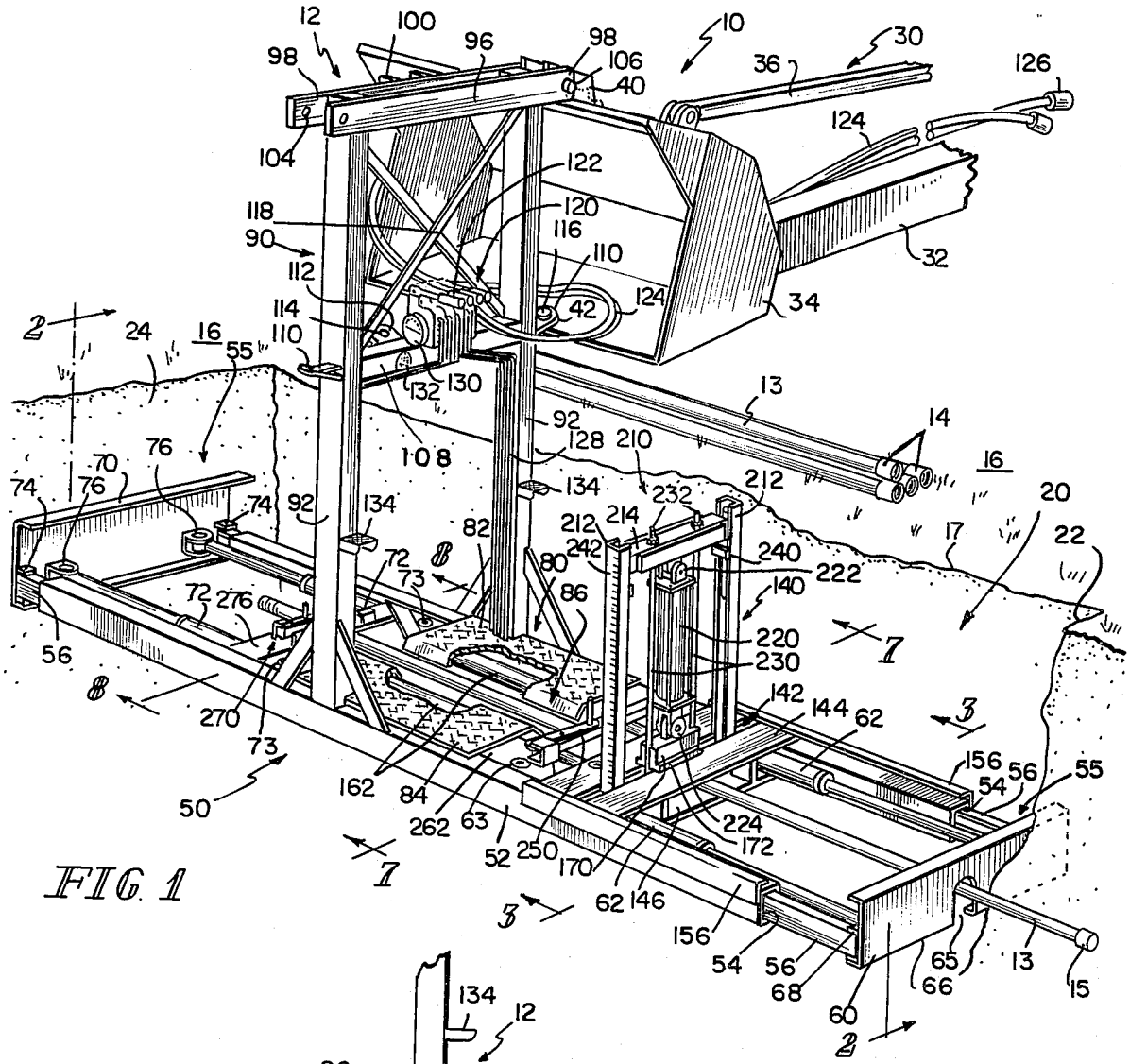
FIG. 1 is a perspective view of the pipe-pressing apparatus of the present invention.
Figure 2:
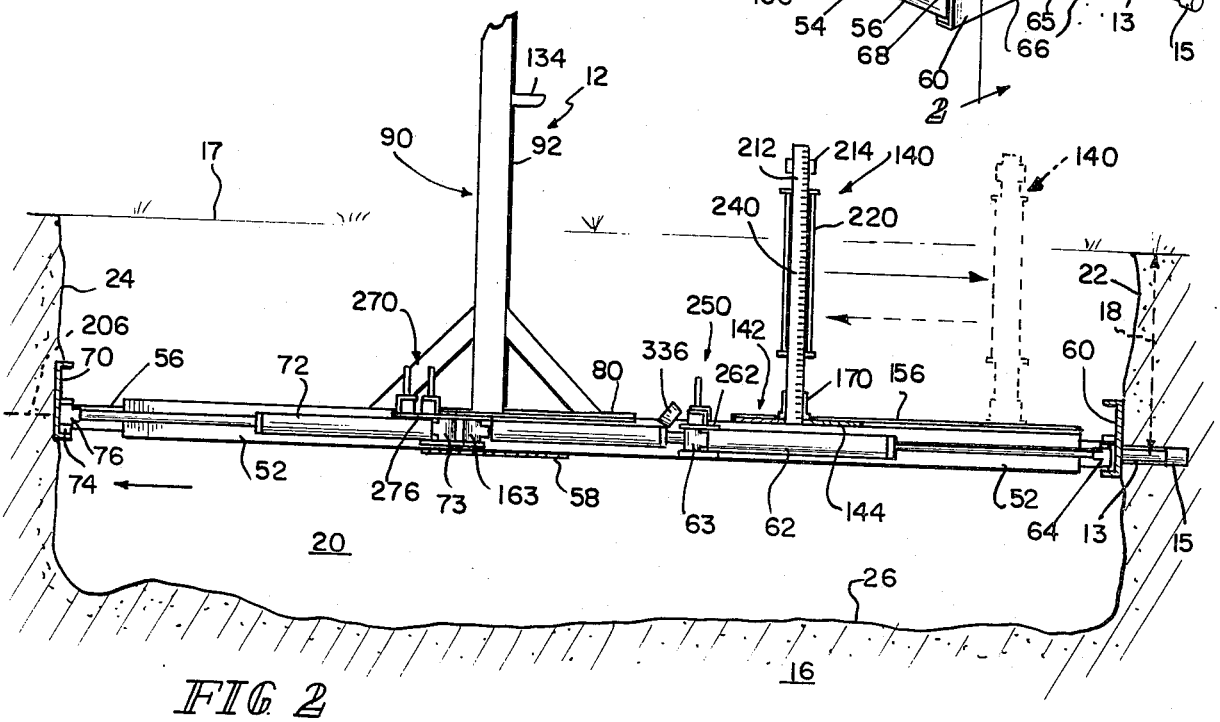
FIG. 2 is a cross-sectional view of the apparatus shown in FIG. 1 taken generally along section lines 2—2.

Referring now more particularly to the drawings, a maneuverable pipe-pressing apparatus 10 constructed in accordance with the present invention is shown in FIGS. 1 and 2. The apparatus 10 includes a pipe-pressing assembly 12 for pressing pipe 13 through the ground 16. Although the assembly 12 is described hereinafter with respect to pressing pipe 13, it will be understood that the assembly 12 may also be used to press rods or conduit through the ground and therefore it is not intended that the assembly 12 be limited to pipe pressing. As shown, the pipe 13 will typically have a coupling device 14 connected to at least one of its ends for connecting numerous sections of pipe. In order to protect the end of the first pipe section 13 to be pressed through the ground 16, a nipple cap or plug in a coupling 15 may be placed on the end of the pipe 13 as illustrated in FIGS. 1 and 2. It should be noted that these couplings 14, 15 are in most instances greater in diameter than the pipe 13 itself.

For illustrative purposes, the apparatus 10 will be described with respect to its use in pressing pipe through the ground 16 beneath the ground surface 17 at a desired depth 18 in an excavation 20. The excavation 20 will naturally have associated with it a bottom 26 and at least two walls 22 and 24 which are transverse to the pressing forces and movement of the pipe 13 through the ground. Importantly, however, it should be understood that while the apparatus 10 will be described with respect to its use in an excavation 20, the apparatus 10 may also be employed to press pipe 13 through the ground 16 in other situations where there are at least two transverse surfaces to the movement of the pipe for stabilizing the pipe-pressing assembly 12 once it has been positioned between the two surfaces. For example, the assembly 12 may be positioned between two concrete walls.

Figure 9:
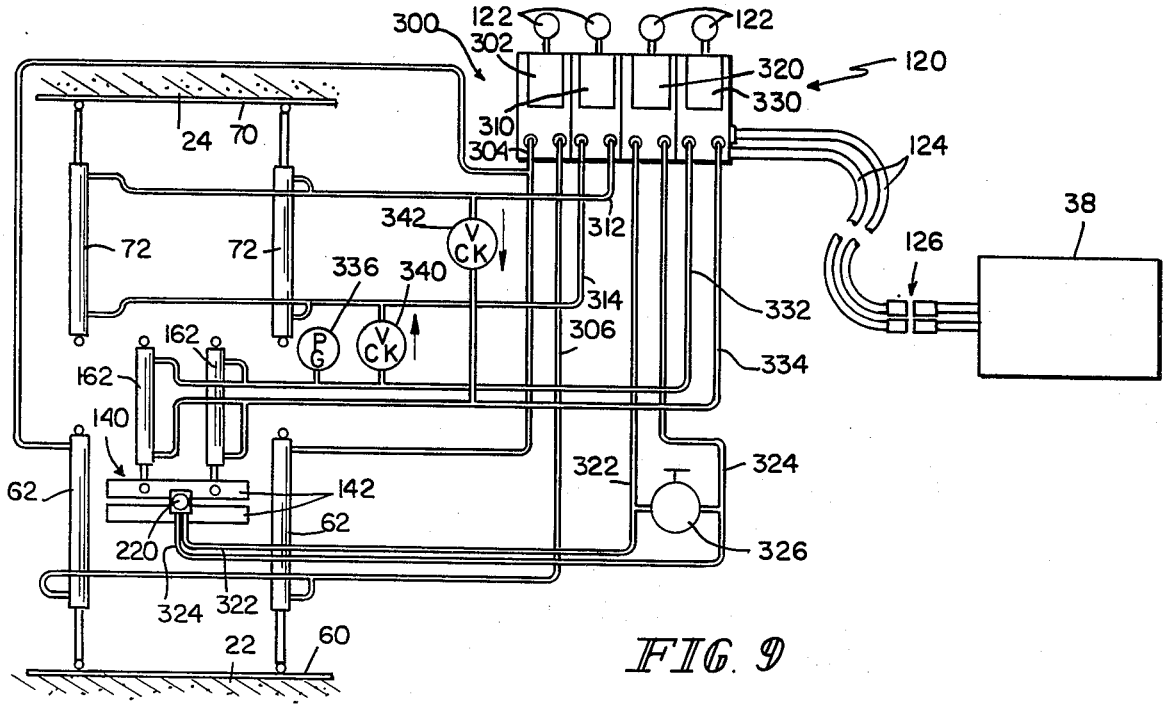
FIG. 9 is a diagrammatic view of the apparatus shown in FIG. 1.

The maneuverable pipe-pressing apparatus 10 further includes a vehicle 30 having a movable boom 32 for carrying the pipe-pressing assembly 12. In the preferred embodiment of the apparatus 10, the vehicle 30 is a front end loader having a bucket 34 connected to the movable boom 32 which is controllable from the vehicle 30 by an armature 36. It will be understood that the vehicle 30 of the preferred embodiment may also be used to initially dig the excavation 20. As best illustrated in FIG. 9, the vehicle will also have a hydraulic power supply 38 which is used to move the boom 32 and tilt the bucket 34 and which further may be used to drive the pipe-pressing assembly 12. Provided on the top of the bucket 34 is a bracket 40 for mounting the assembly 12 to the vehicle 30. Further, an aperture is provided in the bottom surface of the bucket 34 to also support the assembly 12. Therefore, when the bucket 34 is raised or lowered by the operator of the vehicle 30, the assembly 12 mounted to the bucket 34 will also be raised or lowered. Further, when the bucket 34 is tilted by the operator of the vehicle 30, the assembly 12 may be raised or lowered in small increments so that it may be accurately positioned within the excavation 20. Although the vehicle 30 is not completely shown in the figures, it will preferably have at least wto hydraulic pads which engage the ground surface 17 and allow the vehicle 30 to be tilted from one side to another so that the assembly 12 may likewise be tilted to a desired degree of elevation within the excavation 20. These pads are commonly referred to as outriggers and are typically associated with front end loaders.

Continuing to view the apparatus 10 as shown in FIGS. 1 and 2, the pipe-pressing assembly 12 includes a frame 50 having a stationary frame structure 52 including two parallel channels 54 for slidably receiving two movable frame structures 55. As best illustrated in FIGS. 2, 3, 4, 7, and 8, the two parallel channels 54 are connected by a cross brace 58 to form a single unit. It should be noted that other cross braces serving other functions in addition to connecting the two channels 54 are also welded or connected to the channels 54 to form the stationary frame structure 52. Each movable frame structure 55 includes two parallel rails 56 slidably positioned within the channels 54 and pivotally connected to end plates 60 and 70 at points 64 and 74, respectively. Importantly, it should be understood that the rails 56 for plates 60 and 70 are not connected to each other and in fact are separated units received by the channels 54.

Front end plate 60 is rectangular in shape and is projectable to engage front wall surface 22 of the excavation 20. Two double-action or bidirectional hydraulic piston and cylinder mechanisms 62 are supported by the stationary frame structure 52 at points 63 in parallel with and in generally the same plane as each of the two parallel channels 54. Each mechanism 62 is also pivotally connected to the front end plate 60 at points such that end plate 60 is rotatable to conform to the front wall surface 22. The end plate 60 includes a U-shaped gate or aperture 65 for receiving and guiding the pipe 13 through the ground 16. Importantly, the U-shaped gate 65 is opened at the bottom edge 66 of end plate 60 so that the frame assembly 12 may be removed from the excavation 20 while a portion of the pipe 13 protrudes from front wall surface 22. In many instances it is desirable that a portion of the pipe 13 protrude from the surface 22 after the pressing has been completed so that additional pipe or other apparatus may be coupled to the protruding end.

Rear end plate 70 is also rectangular in shape and is projectable to engage rear wall surface 24 of the excavation 20. Two double-action or bidirectional hydraulic piston and cylinder mechanisms 72 are supported by the stationary frame structure 52 at points 73 in parallel with and in generally the same plane as each of the two parallel channels 54. The rear end plate 70 is also pivotally connected to hydraulic mechanisms 72 at points 76 to thereby allow the rear end plate 70 to rotate and conform to the rear wall surface 24 of the excavation 20.

Once the pipe-pressing assembly has been positioned within the excavation 20 by the vehicle 30, the front end plate 60 and the rear end plate 70 are projected in opposed directions by the hydraulic mechanisms 62 and 72 to thereby engage the front wall surface 22 and the rear wall surface 24, respectively, and stabilize the assembly 12 between the two wall surfaces 22, 24. Furthermore, the front end plate 60 and the rear end plate 70 are independently retractable for disengaging the front wall surface 22 and the rear wall surface 24 once the pipe-pressing process has been completed so that the assembly 12 may be lifted from the excavation 20 by the vehicle 30. As best illustrated in FIG. 2, the two plates 60, 70 serve as feet for the assembly 12 which engage surfaces 22, 24 to provide necessary stability and control for the apparatus 10.

A stage 80 is centrally carried by the stationary frame structure 52 and includes two halves 82 and 84 which form a channel 86 therebetween for receiving and guiding the pipe in a path parallel to the channels 54 and the hydraulic mechanisms 62 and 72. The stage 80 is provided to allow the operator of the apparatus 10 to position himself on the stationary frame structure 52 and control the operation of the pipe-pressing assembly 12 from that location. Upstanding from the stationary frame structure 52 is a stationary H-frame structure 90 including two posts 92 mounted perpendicular to the stationary frame structure 52. Connected to the top of the post 92 is a first cross member 96 having two upper side mounts 98 and an upper end mount 100 for receiving the bracket 40 provided on the bucket 34 of vehicle 30. The upper mounts 98, 100 are provided with apertures 104 for receiving mounting pins 106. A second cross member 108 is connected at a mid-point along the posts 92 in parallel with the first cross member 96. In the same plane as the second cross member 108 there are also provided two lower side mounts 110. A lower end mount 112 is connected to the second cross member 108 and in the same vertical plane as the upper end mount 100 so that the aperture 42 in the bottom surface of the bucket 34 of vehicle 30 is aligned with apertures 114 provided in the lower mounts 110, 112 and mounting pins 116 are positionable through the apertures 42 and 114 for providing a lower support for the assembly 12. An X-frame support 118 is positioned between the first cross member 96 and the second cross member 108 to provide stability to the stationary H-frame structure 90.

Positioned on the second cross member 108 are four hydraulic controls 120, each having a two position control lever 122. Hydraulic fluid lines 124 including a supply and return line are extended from the hydraulic controls 120 and include a quick disconnect coupling 126 for coupling the hydraulic systems of the assembly 12 to the hydraulic power supply 38 of the vehicle 30. The hydraulic system lines 128 connecting the various hydraulic mechanisms of the assembly 12 with the hydraulic controls 120 are mounted along one of the H-frame posts 92 to fix them out of the way of the operator. Further provided on the second cross member 108 and on either side of the hydraulic controls 120 are two protractors 130 for measuring and gauging various angles of inclination of the assembly 12 with respect to the ground surface 17. Protractors 130 are provided on both sides of the hydraulic controls 120 so that they are readable by the operator depending upon the position of the vehicle 30 with respect to the assembly 12. Also provided on the second cross member 108 is a conversion chart 132 for determining the angle of elevation of the assembly 12 necessary to assure that the leading end 15 of the pipe 13 is pushed to its desired location within the ground 16. Steps 134 are provided on the posts 92 to allow the operator to step from the ground surface 17 to the platform 80. It can therefore be seen that the operator can control the complete operation of the assembly 12 from the stage 80 carried by the frame 50.

Figure 3:
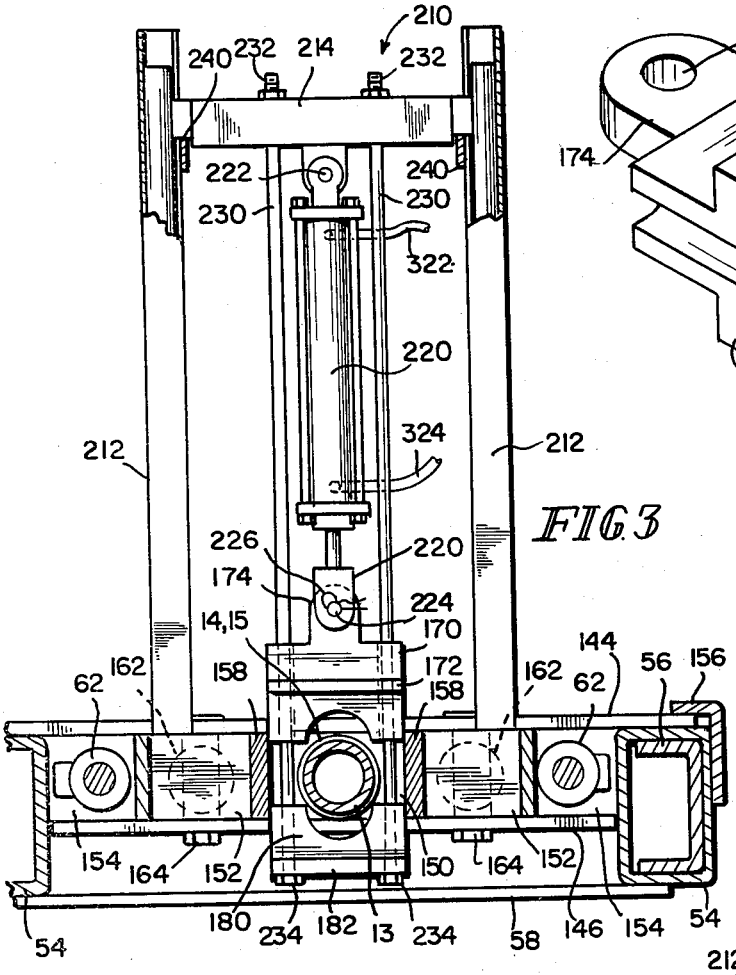
FIG. 3 is a cross-sectional view of the apparatus shown in FIG. 1 taken generally along section lines 3—3.
Figure 4:
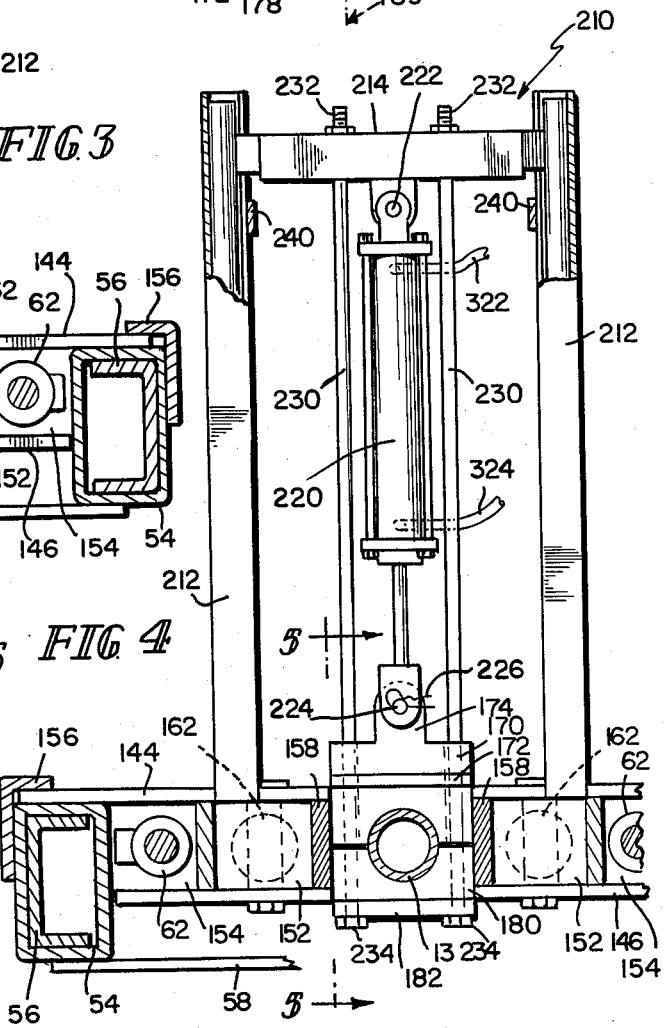
FIG. 4 is another sectional view taken along section lines 3—3 of FIG. 1 illustrating the operation of a portion of the apparatus.
Figure 5:
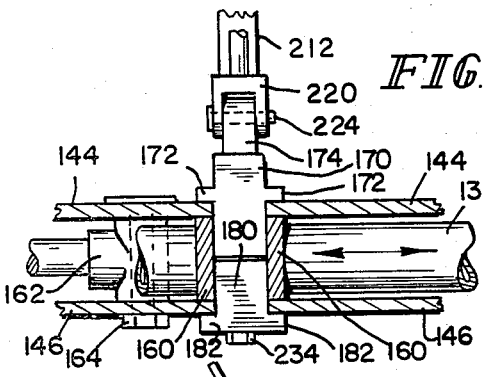
FIG. 5 is a sectional view of the apparatus of FIG. 1 taken generally along section lines 5—5 of FIG. 4.

As illustrated in FIGS. 1 and 2, a movable clamping mechanism 140 is carried by the channels 54 of the stationary frame structure 52 and includes a housing 142 having an upper surface 144 slidably engaging top surfaces of the channels 54 and a lower surface 146 which slidably engages inner side surfaces of the channels 54 to guide movement of the housing 142 along the stationary frame structure 52. Referring more particularly to FIGS. 3, 4, and 5, the housing 142 includes a central chamber 150 for receiving a portion of the pipe 13. The housing 142 further includes two inner chambers 152 and two outer chambers 154. The central chamber 150 includes two side walls 158 and two end walls 160 with the end walls 160 including apertures for receiving the pipe 13.

In order to provide a further guide for the movement of housing 142, L-shaped guides 156 are welded to an outer side surface of the channels 54 and cover the top surface 144 of the housing 142.

Two double-action or bidirectional hydraulic piston and cylinder mechanisms 162 are supportable by the stationary frame structure 52 at points 163, as best illustrated in FIG. 2, and are mounted in parallel to the housing 142 within the inner chambers 152 at points 164. The housing 142 is therefore bidirectionally movable along the stationary frame structure in response to actuation of the hydraulic mechanisms 162.

Figure 6:
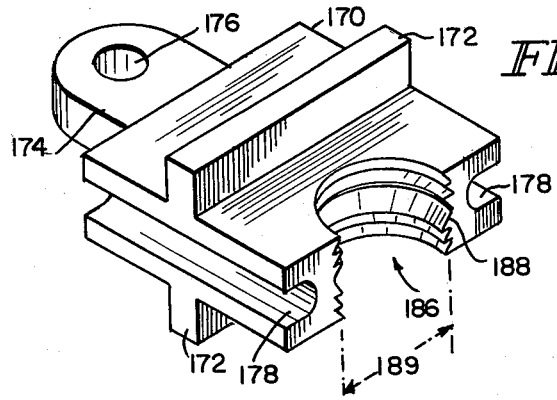
FIG. 6 is a perspective view of a section of the apparatus shown in FIG. 3.

The clamping assembly 140 further includes an upper clamp 170 and a lower clamp 180 for grasping the portion of the pipe 13 received by the central chamber 150 of housing 142. The upper clamp 170 includes a flange 172 for engaging the upper surface 144 of the housing 142 to limit the downward movement of the upper clamp 170 within the central chamber 150. The upper clamp 170 further includes a tongue 174 with an aperture 176 provided therein, as best illustrated in FIG. 6. The tongue 174 allows another hydraulic system to be attached to the upper clamp 170 for controlling the movement thereof.

The lower clamp 180 includes a flange 182 for engaging the lower surface 146 of the housing 142 to limit its upward movement within the central chamber 150. There is further provided in the lower clamp 180 two bores 184 which, as will be described later, are utilized to attach the lower clamp 180 to the hydraulic system for controlling its movement.

Figure 10:
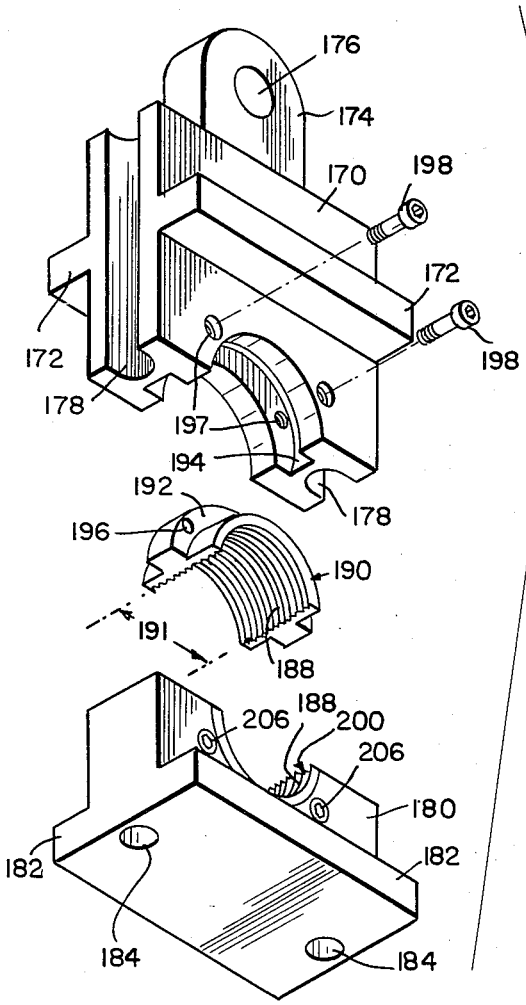
FIG. 10 is an exploded fragmentary view of the pipe-clamping apparatus shown in FIG. 1.
Figure 10A:
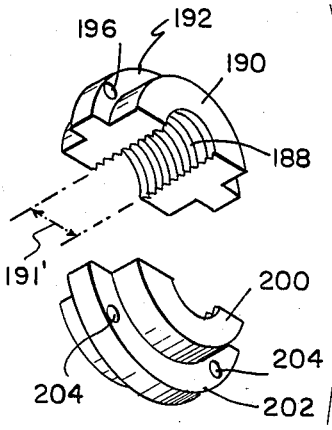
FIG. 10*a* is a further fragmentary view of a portion of the fragment shown in FIG. 10.

As shown in FIGS. 6, 10, and 10*a*, the upper and lower clamps 170, 180 include generally semicircular jaws 186 having a series of teeth 188 provided around the periphery of the jaw 186 for grasping the pipe 13 as it is received by the housing 142. The semicircular jaw 186 has a diameter 189 substantially equivalent to the diameter of the pipe 13. Further, each jaw 186 and clamp 170, 180 is constructed of a desirable material such as steel and heat-treated. It should be noted that the teeth 188 are shown in FIG. 6 as having a bidirectional bite; however, the apparatus 10 will also function using a unidirectional bite.

Referring more particularly to FIGS. 10 and 10*a*, one embodiment of the clamps 170, 180 includes a removable upper jaw 190 having a diameter 191 again corresponding to the diameter of the pipe 13. The removable jaw 190 also includes a series of teeth 188 and is provided with an annular tongue 192 which is insertable into an annular groove 194 formed in the clamp 170. A series of apertures 196 are provided in the tongue portion 192 of the removable jaw 190 and are alignable with a series of apertures 197 provided in the annular groove 194 of the upper clamp 170 such that screws 198 are threadably received by the annular groove 194 and the annular tongue 192 to firmly attach the jaw insert 190. A lower removable jaw 200 is also provided in the lower clamp 180 and likewise includes an annular tongue 202 having a series of apertures 204 for coupling to the lower clamp 180 utilizing screws 206 in the manner described hereinabove. Importantly, it should be noted that these jaw inserts 190, 200 allow one to interchange and replace the jaws as needed. As illustrated in FIG. 10*a*, the upper and lower removable jaws 190, 200 are replaceable by jaws having either a larger or smaller diameter 191' so that pipe 13 of various diameters may be accommodated by the pipe-pressing assembly 12.

Referring again to FIGS. 1 and 2, it is important to note that the two parallel channels 54 of the stationary frame structure 52, the hydraulic mechanisms 62, 72, and 162; and the pipe 13 are each positioned and supported by the frame structure 52 in parallel to each other and in a single plane 206 relative to the pipe-pressing assembly 12. Accordingly, the forces associated with stabilizing the pipe-pressing assembly against the wall surfaces 22 and 24 and in pressing the pipe 13 through the ground 16 are all contained within the same plane 206. Therefore, no forces are applied to the vehicle 30 or to the hydraulic system associated with the clamping mechanism 140 during the operation of the pipe-pressing assembly 12.

As shown in FIGS. 1, 3, 4, and 5, the clamping mechanism 140 further includes a floating H-frame structure 210 mounted to the housing 142 so that the H-frame 210 moves in association with the movement of the housing 142. The H-frame structure 210 includes two parallel upstanding channels 212 for slidably receiving and guiding a cross member 214 wherein the cross member 214 is allowed to move up and down along the channels 212. Connected to the cross member 214 and to the upper clamp 170 is another double-action or bidirectional hydraulic mechanism 220 for controlling the upward and downward movements of the clamps 170, 180. It should be noted that the mechanism 220 is removably connected to the cross member 214 at point 222 and also removably connected to the upper clamp 170 at point 224 utilizing a cotter pin 226 so that the mechanism 220 is removable from the H-frame structure 210 and the upper clamp 170 is easily replaceable. Also adjustably connected to the cross member 214 are two posts 230 positioned in parallel to the upstanding channels 212 and the hydraulic mechanism 220 for holding the lower clamp 180 and mounting it to the cross member 214. The posts 230 include a threaded end 232 for connection to the cross member 214 and a head 234 for engaging the bottom of lower clamp 180. Accordingly, the posts are received by the bores 184 provided in the lower clamp 180 and adjustably connected to the cross member 214. As shown in FIG. 6, the upper clamp 170 includes two grooves 178 provided at either side of the clamp 170 for receiving the posts 230. These grooves 178 provide a guide for the upward and downward movement of the upper clamp 170. It can therefore be seen that the clamps 170, 180 are self-centering in response to actuation of the hydraulic mechanism 220.

It is important to note in FIG. 3 that the separation between the upper clamp 170 and the lower clamp 180 is sufficient to allow the couplings 14, 15 to pass between the jaws 186, 170, 180 of the clamps so that the clamping assembly 140 does not have to be dismantled in order to insert additional sections of the pipe 13. This separation between the upper and lower clamps 170, 180 is established first by two limit stops 240 located on the channels 212 which limit the downward movement of the cross member 214 and therefore limit or establish the position of the lower clamp 180 when the clamps 170, 180 are separated. Secondly, the separation is further adjustable by adjusting the connections of the posts 230 to the cross member 214. Accordingly, the separation between the two clamps 170, 180 in their unclamped position can be adjusted by the operator to accommodate any desirable diameter of pipe 13 and the couplings 14, 15 which may be attached to their ends.

As shown in FIGS. 1 and 2, the upstanding channels 212 associated with the H-frame structure 210 include a calibrated scale for measuring and gauging the depth 18 of the pipe-pressing assembly 12 in the excavation 20. By citting along the ground surface 17 to the graduated scales 242, the operator of the pipe-pressing assembly 12 is able to position the assembly 12 at the desired depth 18 without the need of additional equipment to do so.

Referring now to FIGS. 3, 4, and 5, the operation of the clamping mechanism 140 can be described. Initially, the upper and lower clamps 170, 180 are separated and the pipe 13 will be received by the central chamber 150 of the housing 142. In response to hydraulic pressures applied by actuation of the mechanism 220, the upper clamp 170 will be moved downward into the central chamber 150 of the housing 142 until the flange 172 engages the upper surface 144 of the housing 142. Upon further application of hydraulic pressure to the upper clamp 170, the cross member 214 is forced upward and floats along the channels 212 to draw upwardly the lower clamp 180 until the flange 182 either engages the lower surface 146 of the housing 142 or the pipe 13. As the lower clamp 180 is drawn towards the upper clamp 170, the jaws 186 of the upper and lower clamps 170, 180 engage the pipe 13, thereby grasping a portion of the pipe 13. Accordingly, the portion of the pipe 13 received by the central chamber 150 of the housing 142 is captured within the central chamber 150 by the clamps 170, 180 and the four walls 158 and 160 of the center chamber 150. It is therefore apparent that when hydraulic forces are applied to the housing 142 by hydraulic mechanisms 162, the H-frame structure 210 and the hydraulic mechanism 220 float with the housing 142 as the pipe 13 is pressed through the ground 16 and that the forces are limited to the housing 142 and the clamps 170, 180. In the preferred embodiment, each stroke of the hydraulic mechanisms 162 travels a distance of twenty-six inches. After each stroke, the clamps 170 and 180 are separated by actuating the hydraulic mechanism 220 and the housing 142 is returned to its initial position to clamp another portion of the pipe 13.

Figure 8:
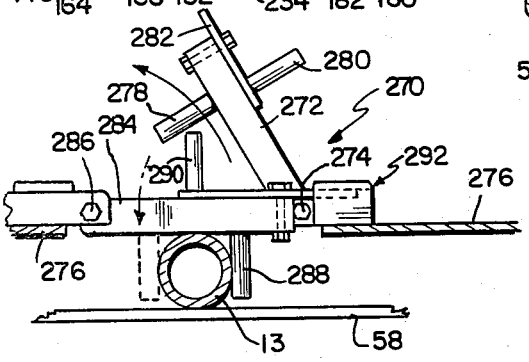
FIG. 8 is a sectional view of the apparatus shown in FIG. 1 taken generally along section lines 8—8.
Figure 7:
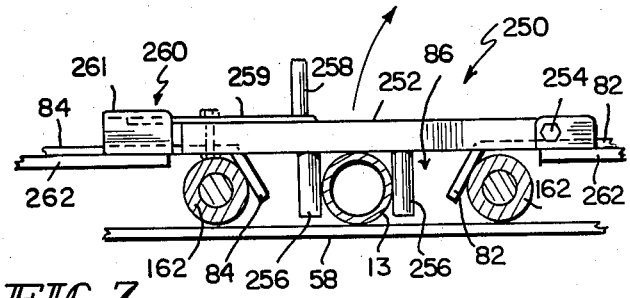
FIG. 7 is a sectional view of the apparatus shown in FIG. 1 taken generally along section lines 7—7.

Referring now to FIGS. 7 and 8, two guides 250 and 270 are pivotally mounted to the stationary frame structure 52 of the pipe-pressing assembly 12 to guide movement of the pipe 13 as it is pressed through the ground 16. A front guide 250 illustrated in FIG. 7 includes an armature 252 pivotally mounted to the frame 52 at a point 254 carried by a support plate 262. The armature 252 has two guide posts 256 attached to its bottom surface and positioned in spaced parallel relationship having a distance between the two posts 256 slightly greater than the diameter of the pipe 13 so that the movement of the pipe is not restricted by posts 256. The armature 252 further includes a handle 258 pivotally connected to the armature 252 on a movable plate 259 to allow the operator to pivot the armature 252 in the direction of the arrow shown in FIG. 7. The movable plate 259 forms a part of a latch assembly 260 which also includes a U-shaped housing 261 for capturing the plate 259 in response to rotation thereof using the handle 258. Accordingly, the operator is able to unlatch the armature 252, pull it upward, and place a pipe 13 in the assembly 12 and then latch the armature in a position such that the posts 256 provide a guide for movement of the pipe 13 through the assembly 12.

Also pivotally mounted in tandem to the frame structure 52 are rear guides 270 including a first armature 272 pivotally connected to a support plate 276 carried by the housing at a point 274. The first armature 272 includes a single guide post 278, a handle 280, and a latch assembly 282 identical to the post, handle, and latch assembly previously described for the front guide 250. A second armature 284 is also pivotally connected to the support plate 276 at a point 286 and includes another guide post 288 such that when the first armature 272 and the second armature 284 are latched in position, the distance between the guide posts 278 and 288 is slightly greater than the diameter of the pipe 13. The second armature further includes a handle 290 and a latch assembly 292 again similar in construction to the handle and latch assembly of the front guide 250. It should be noted that while the posts 278, 288 are in spaced parallel relationship when the armatures 272, 284 are latched in position, they are not contained within the same plane and in fact are offset from each other.

The total operation of the pipe-pressing assembly 12 can best be described by referring to FIG. 9 and describing the operation of the hydraulic systems 300. The assembly 12 includes four independently operable hydraulic systems 300 which are controllable by hydraulic controls 120 mounted to the stationary H-frame structure 90 of the assembly 12. A first hydraulic system 302 for projecting and retracting the front end plate 60 includes the two double-action hydraulic mechanisms 62, supply and return hydraulic lines 304 and 306 connected to each of the hydraulic mechanisms 62 and a two position control lever 122. The front end plate 60 is projectable and retractable in response to forces applied thereto upon actuation of the mechanisms 62. The two positions associated with the lever 122 include a forward position and a reverse position. When the lever 122 is placed in the forward position, hydraulic fluid is forced into the rear of the mechanisms 62 along line 304 to project the front end plate 60 against the wall surface 22. In this action, the line 306 serves as a return line for returning hydraulic fluid contained in the opposite end of the mechanisms 62 to the supply 38 of the vehicle 30. When the lever 122 is placed in the reverse position, hydraulic fluid is supplied through line 306 to the forward portion of the mechanisms 62 to thereby retract the front end plate 60 and in this action the line 304 serves as a return line for hydraulic fluid. From each position, the lever 122 is automatically returned to lock the hydraulic system 302 in its present state when the operator removes his hand from the lever 122.

A hydraulic system 310 for projecting and retracting the rear end plate 70 also includes the two hydraulic mechanisms 72, a lever 122 having two positions as enumerated hereinabove, and supply and return hydraulic lines 312 and 314. The operation of the hydraulic system 310 for the rear end plate 70 is substantially identical to the operation of the hydraulic system 302 for the front end plate 60, i.e., the rear end plate 70 is projected in response to one position of the lever 122 and retracted in response to another position of the hydraulic lever 122. The rear end plate 70 is projectable to engage the wall surface 24 and retractable in response to forces applied thereto upon actuation of mechanisms 72.

A hydraulic system 320 for operating the clamping mechanism 140 includes the hydraulic mechanism 220 and supply and return lines 322 and 324 also shown in FIGS. 3 and 4. Again, the position of the control lever 122 will determine the direction of the action of the mechanism 220. The hydraulic lines 322 and 324 will either be a supply line or a return line and the clamps 170, 180 (see FIGS. 3 and 4) will either be drawn together or separated in response to the position of the control lever 122 for hydraulic system 320. Connected between the hydraulic lines 322 and 324 is an adjustable pressure-release valve 326. This valve is provided in the hydraulic system 320 to assure that the forces being applied by the clamping mechanism 140 to the housing 144 and/or the pipe 13 do not surpass a limit point and thereby cause damage to the housing 144 and/or the pipe 13. When the hydraulic pressure in line 322 reaches a value adjustably set at the pressure-release valve 326, hydraulic fluid is allowed to pass through the valve 326 to return line 324 to release the pressure.

A hydraulic system 330 for applying pressing force to the housing 144 to press the pipe 13 through the ground 16 includes the hydraulic mechanisms 162 and supply and return hydraulic lines 332 and 334. Again, the position of the control lever 122 will determine the direction of the action of the mechanisms 162. The hydraulic mechanisms 162 will apply a force against the housing 144 of the clamping mechanism 140 to press the pipe through the ground 16 and retract the housing 142 or the pipe 13. The hydraulic lines 332 and 334 will serve as either a supply line or a return line depending upon the direction in which the housing 142 is being moved. For reasons to be described hereinafter, a pressure gauge 336 is provided in the hydraulic line 332 associated with the application of pressing forces against the housing 142. As best illustrated in FIG. 1, the pressure gauge 336 is positioned on the stationary frame structure 52 of the pipe-pressing assembly 12 so that the operator standing on the stage 80 is able to continually monitor the pressing forces being applied to the pipe 13.

Continuing to refer to FIG. 9, hydraulic line 314 of the hydraulic system 310 for projecting and retracting the rear end plate 70 is connected to the hydraulic line 332 of the hydraulic system 330 for applying force against the housing 142 to press the pipe 13 through the ground 16. The connection between these two hydraulic lines 314, 332 includes a unidirectional check valve 340 which allows hydraulic fluid to flow in the direction indicated by the arrow in FIG. 9. In operation, as hydraulic fluid is supplied by line 332 to the mechanisms 162 to press the pipe 13 through ground 16, it also has the ability to flow unidirectionally into line 314 to further project the rear end plate 70 and provide a corresponding opposing force against the rear end wall 24. Since hydraulic fluid has a tendency to seek a path of least resistance, as the force required to press the pipe 13 increases, more of the hydraulic fluid in line 332 is forced into hydraulic line 314 to produce the opposing force against the rear wall surface 24. Therefore, the forces being applied against the housing 142 to press the pipe 13 and the opposing force being applied against the rear wall surface 24 by the rear end plate 70 are continuously balanced. Since it is possible that these opposing forces could continue to build when the pipe has struck an immovable object located beneath the ground surface 17, the pressure gauge 336 in line 332 allows the operator to continuously monitor the forces being applied by the rear end plate 70 to the rear wall surface 24 and to the housing 142 to press the pipe 13 through the ground 16. Furthermore, by monitoring the forces the operator is able to determine when in fact he has struck an object and thereafter retract the pipe 13 before damaging the object.

During the pipe-pressing operation of the assembly 12, the hydraulic lines 312 and 334 associated with the systems 310 and 330 serve as return lines for hydraulic fluid associated with those systems. Accordingly, it is necessary that another unidirectional check valve 342 connect lines 312 and 334 so that the hydraulic fluid being forced into line 312 when the end plate 70 is being projected can be returned through line 334. Without this check valve 342, it can be appreciated that the projection of the end plate 70 would be limited by the hydraulic fluid present in line 312. As can be seen from the system arrangement shown in FIG. 9, the two unidirectional valves 340 and 342 allow continuous pressure to be applied to back wall surface 24 corresponding to the pressure being applied to the housing 142 to press the pipe 13 through the ground 16.

In one embodiment of the apparatus 10, two and one-half inch diameter hydraulic cylinders have been used for mechanisms 62, 72, 162, and 220 resulting in 18,000 lbs. of pressing force. With these cylinders and the vehicle operating to supply twenty-three gallons of hydraulic fluid per minute, the assembly 12 has the capability of a press rate of at least ten feet of pipe per forty seconds. Accordingly, twenty feet of pipe 13 can be pressed through the ground 16 within two minutes utilizing the twenty-six inch stroke of the hydraulic mechanisms 162.

What I claim is:

1. An apparatus for maneuvering pipe through the ground comprising a frame, front and rear feet movably carried by the frame for engaging opposed surfaces, each surface being transverse to movement of the pipe, a housing movably carried by the frame for receiving the pipe, pipe-clamping means carried on the housing for clamping the pipe, a first hydraulic system for moving the rear foot in first and second directions, a second hydraulic system for moving the front foot in the first and second directions, first and second control means for actuating the first and second hydraulic systems, respectively, to move the rear foot in the second direction to engage one of the surfaces and to move the front foot in the first direction to engage the other surface thereby stabilizing the frame between the surfaces, a third hydraulic system for moving the housing and pipe-clamping means in the first and second directions, a third control means for actuating the third hydraulic system to move the housing and pipe-clamping means in the first direction to apply a force needed to move the pipe through the ground in the first direction, fluid-communicating means between the first direction, fluid-communicating means between the first and third hydraulic systems for allowing fluid to pass from the third system to the first system and from the first system to the third system, an increase in the force in the first direction needed to move the pipe causing fluid to pass from the third hydraulic system to the first hydraulic system to move the rear foot in the second direction and apply a corresponding force to the one surface, the fluid-communicating means allowing fluid to pass from the first hydraulic system to the third hydraulic system to continuously balance the forces in the first and second directions.

2. The apparatus as recited in claim 1 wherein each of the first and second hydraulic systems includes at least one double-acting piston and cylinder mechanism connected between the frame and one of the feet and the third hydraulic system includes at least one double-acting piston and cylinder mechanism connected between the frame and the housing.

3. The apparatus as recited in claim 2 wherein each hydraulic system includes two piston and cylinder mechanisms, and each of the feet is pivotally connected to two piston and cylinder mechanisms and a movable structure of the frame.

4. The apparatus as recited in claim 2 wherein the piston and cylinder mechanisms and the pipe are carried by the frame in parallel relationship in generally the same plane.

5. The apparatus as recited in claim 4 wherein the feet are carried by the frame generally perpendicular to and in the same plane as the piston and cylinder mechanisms and the pipe.

6. The apparatus as recited in claim 1 wherein the communicating means includes a first unidirectional valve means for allowing hydraulic fluid to flow from the third hydraulic system to the first hydraulic system and second unidirectional valve means for allowing hydraulic fluid to flow from the first hydraulic system to the third hydraulic system.

7. The apparatus as recited in claim 6 wherein hydraulic fluid passes through the first valve means into the first hydraulic system when the force in the first direction needed to move the pipe exceeds the existing force being applied by the rear foot in the second direction to increase the magnitude of the force in the second direction, and hydraulic fluid passes through the second valve means into the third hydraulic system to balance the forces in the first and second directions.

8. The apparatus as recited in claim 1 wherein the pipe-clamping means includes two parallel guides mounted to the housing, a cross member slidably carried by the guides to allow movement thereof relative to the housing, first stop means for limiting downward movement of the cross member, upper and lower clamp jaws, a fourth hydraulic system for moving the jaws, the fourth hydraulic system including a double-acting piston and cylinder mechanism, first connecting means for connecting one end of the piston and cylinder mechanism to the upper clamp jaw, second connecting means for connecting the other end of the piston and cylinder mechanism to the cross member, third connecting means for connecting to cross member to the lower jaw, fourth control means for actuating the piston and cylinder mechanism to move the upper clamp jaw and the cross member in opposite directions relative to the housing, second stop means for limiting downward movement of the upper clamp jaw, clamping actuation of the piston and cylinder mechanism moving the upper clamp jaw downward until it is stopped by the second stop means and thereafter moving the cross member and lower clamp upward to complete clamping of the pipe, and unclamping actuation of the piston and cylinder mechanism moving the cross member and lower clamp jaw downward until the cross member is stopped by the first stop means and thereafter moving the upper clamp jaw upward to complete unclamping of the pipe.

9. An apparatus for pressing pipe through the ground comprising a frame assembly; the frame assembly including movable front and rear means for engaging opposed surfaces which are transverse to movement of the pipe to stabilize the frame assembly; a housing movably carried by the frame for receiving the pipe; clamping means supported by the housing for clamping a portion of the pipe received in the housing; the clamping means including clamp jaws movable in the housing to grip the portion of the pipe received in the housing, the jaws being captured in the housing to limit application of pressing forces to the housing and clamp jaws; a first hydraulic system for projecting and retracting the rear surface-engaging means, a second hydraulic system for projecting and retracting the front surface-engaging means, a third hydraulic system for reciprocally moving the housing, and a fourth hydraulic system for moving the clamp jaws to grip the pipe within the housing; means for actuating the first and second hydraulic systems to protect the front and rear surface-engaging means into engagement with the opposed surfaces; communicating means between the first hydraulic system for projecting and retracting the rear surface-engaging means and the third hydraulic system for reciprocally moving the housing, the communicating means allowing fluid to pass from the third hydraulic system to the first hydraulic system and from the first hydraulic system to the third hydraulic system, means for actuating the third hydraulic system to apply a force to the housing in a direction toward the front surface-engaging means to press the pipe through the ground, fluid being allowed to pass from the third hydraulic system through the communicating means to the first hydraulic system in response to an increase in the force applied to the housing to apply a corresponding opposing force against the surface engaged by the rear surface-engaging means, and fluid being allowed to pass from the first hydraulic system to the third hydraulic system to continuously balance the opposing forces.

10. The apparatus as recited in claim 9 wherein the surface-engaging means includes front and rear feet, the front foot includes a hole for guiding the pipe into the ground through the surface engaged by the front foot, the hole is opened at the bottom edge of the front foot to allow the frame to be removed while a portion of the pipe is protruding from the surface.

11. The apparatus as recited in claim 10 wherein the frame assembly further includes at least one means for guiding the movement of the pipe, the guiding means being pivotally mounted to the frame to allow placement and removal of the pipe.

12. The apparatus as recited in claim 9 wherein the fourth hydraulic system for clamping the pipe within the housing includes an adjustable pressure-release valve for releasing pressure being applied to the housing and pipe at a predetermined set value.

13. The apparatus as recited in claim 9 wherein the third hydraulic system for reciprocably moving the housing to press the pipe includes a pressure gauge located within the system to continuously monitor pressure being applied to the pipe.

14. An apparatus for maneuvering pipe through the ground comprising a stationary frame structure, a surface-engaging frame structure supported by the stationary frame structure for engaging a surface transverse to movement of the pipe and a hydraulically controlled assembly for moving the pipe, the assembly including a housing movably carried by the stationary frame for receiving the pipe, a first double-acting piston and cylinder mechanism for moving the housing, control means for actuating the first double-acting piston and cylinder mechanism to move the housing, two parallel guides mounted to the housing, a cross member slidably carried by the guides to allow movement thereof relative to the housing, first stop means for limiting downward movement of the cross member, means in the housing for clamping the pipe, the clamping means including upper and lower clamp jaws, a second double-acting piston and cylinder mechanism for moving the jaws, means for connecting one end of the second piston and cylinder mechanism to the upper clamp jaw, means for connecting the other end of the second piston and cylinder mechanism to the cross member, means for connecting the lower clamp jaw to the cross member, control means for actuating the second piston and cylinder mechanism to move the upper clamp jaw and cross member in opposite directions relative to the housing and to move the lower clamp jaw in the same direction as the cross member, second stop means for limiting downward movement of the upper clamp jaw, the upper and lower jaws cooperating with the housing to capture a portion of the pipe received by the housing, clamping actuation of the second piston and cylinder mechanism moving the upper clamp jaw downward until it is stopped by the second stop means and thereafter moving the cross member and lower clamp jaw upward to clamp the pipe in the housing, and unclamping actuation of the second piston and cylinder mechanism moving the cross member and lower clamp jaw downward until the cross member is stopped by the first stop means and thereafter moving the upper clamp jaw upward to release the pipe.

15. The apparatus as recited in claim 14 wherein the first stop means includes members mounted on the guides for limiting downward sliding movement of the cross member.

16. The apparatus as recited in claim 15 wherein the second stop means includes a flange on the upper clamp jaw for engaging a surface of the housing and limiting downward movement of the upper clamp jaw into the housing.

17. The apparatus as recited in claim 16 wherein the lower clamp jaw is drawn toward the upper clamp jaw after the flange of the upper clamp jaw engages the housing and the lower clamp jaw also includes a flange for engaging a surface of the housing and limiting movement of the lower clamp jaw into the housing.

18. The apparatus as recited in claim 15 wherein each clamp jaw includes a generally semicircular cross-section jaw insert having a series of teeth for grasping the pipe and a diameter equivalent to the diameter of the pipe.

19. The apparatus as recited in claim 18 wherein the jaw inserts are detachably coupled to the clamping means to allow replacement and variation in the diameter of the clamp jaws.

20. The apparatus as recited in claim 14 wherein the housing includes a four-sided and centrally located chamber for containing the upper and lower clamp jaws.

21. The apparatus as recited in claim 20 wherein the second piston and cylinder mechanism is carried by the housing and moves with the housing relative to the stationary frame structure in response to the first piston and cylinder mechanism.

* * * * *

UNITED STATES PATENT AND TRADEMARK OFFICE

CERTIFICATE OF CORRECTION

PATENT NO. : 4,368,873

DATED : January 18, 1983

INVENTOR(S) : Robert G. Perry

It is certified that error appears in the above-identified patent and that said Letters Patent is hereby corrected as shown below:

Column 4, line 42, delete "wto" and insert --two-- therefor.

Column 8, line 51, delete "citting" and insert --citing-- therefor.

Column 12, line 25, after the comma, delete "fluid-".

Column 12, line 26, delete "communicating means between the first direction,".

Signed and Sealed this

*First* Day of *November 1983*

[SEAL]

*Attest:*

GERALD J. MOSSINGHOFF

*Attesting Officer*

*Commissioner of Patents and Trademarks*